US005295279A

United States Patent [19]

Cooper

[11] Patent Number: 5,295,279

[45] Date of Patent: Mar. 22, 1994

[54] CUP FOR USE ON A PIPELINE

[75] Inventor: Andrew J. Cooper, Swindon, England

[73] Assignee: TDW Delaware, Inc., Wilmington, Del.

[21] Appl. No.: 975,638

[22] Filed: Jan. 13, 1993

[51] Int. Cl.[5] ..... B08B 9/04

[52] U.S. Cl. ..... 15/104.061; 166/202

[58] Field of Search ..... 15/104.061, 104.062, 15/104.063, 3.5, 3.51; 166/121, 153, 170, 202; 33/302, 544.3; 73/865.8

[56] References Cited

U.S. PATENT DOCUMENTS

| | | | |
|---|---|---|---|
| 3,496,588 | 2/1970 | Vernooy | 15/104.06 |
| 3,576,043 | 4/1971 | Zongker | 15/104.06 |
| 3,600,010 | 8/1971 | Vernooy et al. | 285/96 |
| 3,604,041 | 9/1971 | Vernooy | 15/104.06 |
| 3,649,983 | 3/1972 | Vernooy | 15/104.06 |
| 3,704,478 | 12/1972 | Vernooy | 15/104.06 |
| 3,732,625 | 5/1973 | Vernooy | 33/141.5 |
| 3,755,908 | 9/1973 | Vernooy | 33/178 |
| 3,862,497 | 1/1975 | Vernooy | 33/141 |
| 3,868,773 | 3/1975 | Province | 30/130 |
| 3,887,983 | 6/1975 | Province | 29/234 |
| 3,940,855 | 3/1976 | Ver Nooy et al. | 33/174 |
| 4,365,379 | 12/1982 | Neff | 15/104.06 |
| 4,413,370 | 11/1983 | Payne et al. | 15/104.06 |
| 4,457,073 | 6/1984 | Payne | 33/178 |
| 4,522,063 | 6/1985 | Ver Nooy | 73/579 |
| 4,524,526 | 6/1985 | Levine | 33/312 |
| 4,880,028 | 11/1989 | Osburn et al. | 137/315 |
| 4,930,223 | 6/1990 | Smith | 33/302 |
| 4,953,412 | 9/1990 | Rosenberg et al. | 73/865.8 |
| 4,984,322 | 1/1991 | Cho et al. | 15/104.061 |

FOREIGN PATENT DOCUMENTS

| | | | |
|---|---|---|---|
| 0149108 | 6/1981 | Fed. Rep. of Germany | 15/104.061 |
| 1293321 | 2/1987 | U.S.S.R. | 166/153 |

*Primary Examiner*—Edward L. Roberts
*Attorney, Agent, or Firm*—Head & Johnson

[57] ABSTRACT

An improved cup for use on pipeline pigs is formed of a unitary material, such as urethane, the cup having a forward end, a rearward end and a central axis and with an integral flange portion providing means for securing the cup to a pipeline pig, the cup having an intermediate portion extending rearwardly from the flange portion, the intermediate portion having an interior frustro-conical surface and an exterior frustro-conical surface and the cup having a rearward portion, the external surface of the rearward portion curving in an arc to a generally cylindrical configuration. The cup preferably has a plurality of slits formed in the rearward portion, each of the slits being in the plane of the cup central axis and most preferably includes V-shaped grooves in the cup rearward portion external and/or internal surfaces, the grooves being of V-shaped configuration. The provision of the rounded exterior surface of the cup reduces the likelihood of the cup catching on obstructions within the pipeline and the provision of the slits and grooves functioning to increase flexibility of the cup allowing it to more readily deflect inwardly when obstructions in a pipeline interior wall are encountered.

18 Claims, 2 Drawing Sheets

Fig. 3
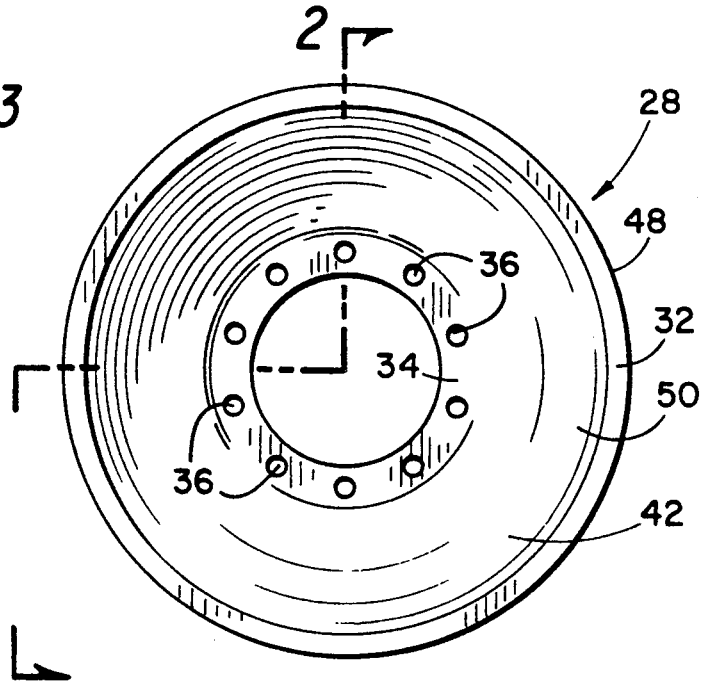
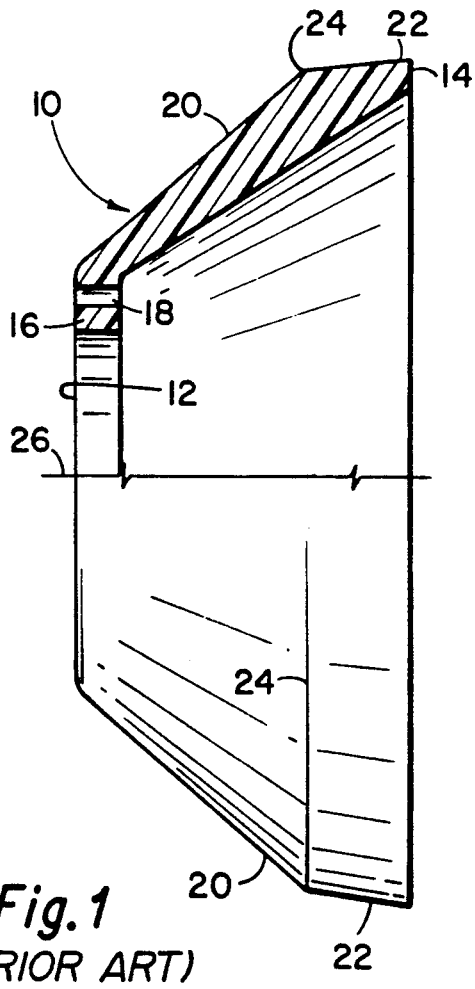
Fig. 1
(PRIOR ART)
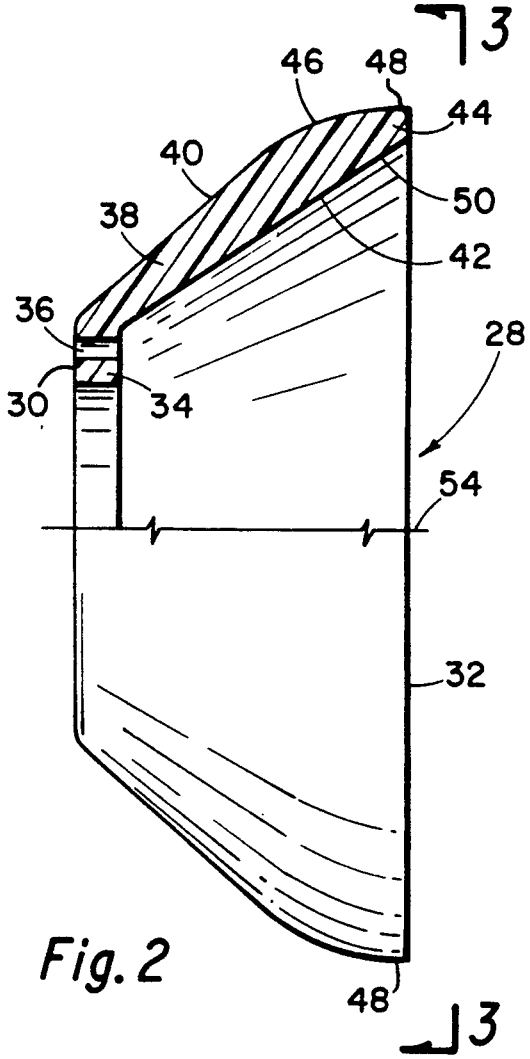
Fig. 2

CUP FOR USE ON A PIPELINE

BACKGROUND OF THE INVENTION

1. Field of the Invention

It is frequently necessary to send mechanical devices through the interior of a pipeline. One reason for using a device that is transmitted through a pipeline, usually referred to as a "pig", is for cleaning the interior surface of the pipeline. Another use for a pipeline pig is for separating one fluid medium from another. Sometimes pipeline pigs are used for pushing out entrapped liquids in a gas transmitting pipeline. Another and very important reason for sending pigs through a pipeline is for gaining information as to the condition of the pipeline. Such pigs are frequently referred to as "instrumentation pigs" and these type of devices can be used to provide information as to the ovality of the pipeline, the interior diameter of various sections of the pipeline, the occurrence of dents, buckles or bulges in the pipeline wall, the detections of bends or changes in direction of the pipeline and the occurrence of corrosion in the pipeline interior or exterior walls.

Pipeline pigs, particularly of the instrumentation type, normally employ cups formed of resilient material, such as urethane. The cups serve two basic functions, that is, (1) they support the body of the pig within the interior of the pipeline and (2) at least one cup for each pig provides a piston-like action so that the flow of the fluid medium, whether liquid or gas, through the pipeline serves to propel the pig within the pipeline.

While the improved cup of this disclosure may be employed on many types of pigs, such as those used for cleaning the interior of a pipeline, the advantages of the improved cup are particularly helpful and important when used on an instrumentation type pig, and the cup will be described as it is particularly applicable for this purpose.

2. The Prior Art

For background information relating to pipeline pigs that employ resilient cups reference may be had to the following U.S. patents:

| U.S. Pat. No. | Title | Inventor | Issue Date |
|---|---|---|---|
| 4,984,322 | Elastomeric Disc For Use On A Pipeline Pig | Cho et al | Jan 15, 1991 |
| 4,953,412 | Pipeline Caliper Pig | Rosenberg | Sep 04, 1990 |
| 4,930,223 | Bend Detector Pig | Smith | Jun 05, 1990 |
| 4,457,073 | Pipeline Pig having Improved Means Of Sensing Changes In The Internal Configuration Of A Pipeline | Payne | Jul 03, 1984 |
| 4,524,526 | Apparatus & Method For Inertial Measurement Of Pipeline Deflection | Levine | Jun 25, 1985 |
| 4,880,028 | Completion Machine | Osburn et al | Nov 14, 1989 |
| 4,522,063 | Methods & Apparatus For Indicating Selected Physical Parameters In A Pipeline | VerNooy | Jun 11, 1985 |
| 4,457,073 | Pipeline Pig Having Improved Means Of Sensing Changes In The Internal Configuration Of A Pipeline | Payne | Jul 03, 1984 |
| 4,413,370 | Unitary Pig For Use In A Pipeline | Payne et al | Nov 08, 1983 |

-continued

| U.S. Pat. No. | Title | Inventor | Issue Date |
|---|---|---|---|
| 4,365,379 | Pipeline Pig Having Improved end Plate Retention | Neff | Dec 28, 1982 |
| 3,940,855 | Pipeline Pig | VerNooy et al | Mar 02, 1976 |
| 3,887,983 | Pipe Pulling Tool | Province | Jun 10, 1975 |
| 3,868,773 | Bean Removal Tool | Province | Mar 04, 1975 |
| 3,862,497 | Pipeline Pig | VerNooy et al | Jan 28, 1975 |
| 3,755,908 | Pipeline Pig | VerNooy | Sep 24, 1973 |
| 3,732,625 | Pipeline Pig | VerNooy | May 15, 1973 |
| 3,704,478 | Pipeline Pig | VerNooy | Dec 05, 1972 |
| 3,649,983 | Pipeline Pig | VerNooy | Mar 21, 1972 |
| 3,604,041 | Pipeline Cleaning Device | VerNooy | Sep 14, 1968 |
| 3,600,010 | Pipeline Coupling | Downs et al | Aug 17, 1971 |
| 3,576,043 | Pipeline Pig With Spring-Mounted Scrapers | Zongler | Apr 27, 1971 |
| 3,496,588 | Pipeline Pig | VerNooy | Jun 26, 1967 |

In addition to the instrumentation type pigs as exemplified by these patents, examples of pigs employing cups that are primarily intended for other purposes, such as cleaning or for fluid separation, are U.S. Pat. Nos. 4,413,370 and 4,365,379.

An object of the present invention is to provide a cup having improvements over cups exemplified by these previously issued patents. The cup to be hereinafter described includes the basic capabilities of the cups illustrated in these patents, that is, for supporting a pipeline pig centrally within a pipeline and for impeding fluid flow therepast so that the pig will be propelled through the pipeline. In addition, the cup to be described has improved strength for supporting a pig body centrally within a pipeline while, at the same time, the cup has greater flexibility. That is, the improved cup of this disclosure more readily flexes inwardly to pass a protrusion in the pipeline wall. In addition, the configuration of the cup is such that it is less likely to catch on or hang up on an object extending within the pipeline wall.

SUMMARY OF THE INVENTION

This invention relates to an improved cup for use on pipeline pigs, such as an instrumentation pig or the like, in which a pig body having one or more cups thereon is propelled through the interior of a pipeline by the force of fluid flow within the pipeline. The cup is formed of unitary resilient material, such as urethane, and has a central axis. At the forward end of the cup is an integral radially extending circumferential flange portion with an axial opening therethrough, the flange portion serving as a means to secure the cup on a pipeline pig body. Rearwardly extending from the flange portion is an intermediate portion of frustro-conical internal and external configuration. At the rearward end of the cup is a rearward portion of increased diameter having an external surface that curves arcuately from the intermediate frustro-conical external surface to form substantially a cylindrical surface, while the interior of the cup rearward portion is a continuation of the intermediate frustro-conical surface. Formed in the cup rearward portion are a plurality of spaced apart slits each in a plane of the cup's central axis and in the preferred arrangement a V-shaped groove or notch is formed at each slit. The cup provides increased strength for supporting a pig body centrally but, at the same time, the cup has flexibility that enables it to deflect inwardly as protruding objects from the pipeline interior wall are encountered as the cup travels in a pipeline.

DESCRIPTION OF THE DRAWINGS

FIG. 1 is an external view, shown partially in cross-section, of a cup as used on an instrumentation-type pipeline pig that is representative of the prior art.

FIG. 2 is an elevational view, shown partially in cross-section, of a cup that is an improvement over the cup of FIG. 1 and that employs the principles of the present invention.

FIG. 3 is a rearward view of the improved cup taken along the line 3—3 of FIG. 2. FIG. 2 is taken along the line 2—2 of FIG. 3.

DESCRIPTION OF THE PREFERRED EMBODIMENTS

Figure 4:
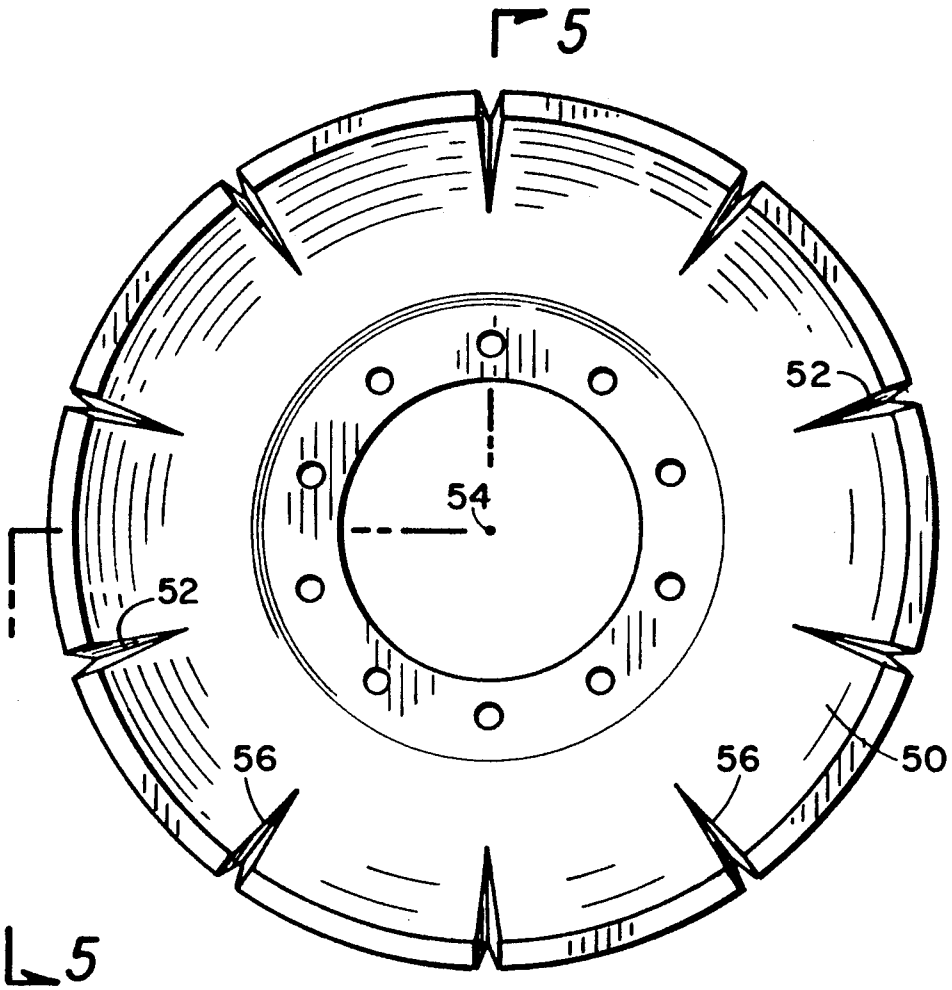
FIG. 4 is a rearward view of an improved embodiment of the cup of FIG. 2.

Referring to FIG. 1, a cup that is representative of the prior art is shown. This is a typical cup that is used on instrumentation pigs or similar pigs for transporting through a pipeline. The prior art cup 10 has a forward end 12 and a rearward end 14. The forward end is formed by an integral flange portion 16 having openings 18 therethrough that can receive bolts by which the cup is held in place on a pig body. The cup has an intermediate portion inclining outwardly and rearwardly towards the rearward end 14. The exterior of the cup is formed by a frustro-conical surface 20 that intersects a second frustro-conical surface 22, the point of intersection providing a circumferential knee 24. The second frustro-conical surface 22 is frequently arranged so that when the cup of FIG. 1 is in position in a pipeline, surface 22 fits against the interior wall of the pipeline and becomes a cylindrical surface, that is, wherein it is cylindrical about the cup central axis 26.

The cup of FIG. 1 works satisfactorily in practice for many applications but it has some problems and limitations. One of the problems is that the circumferential knee 24, being an abrupt angle change in the exterior surface of the pig can tend to catch on or "hang up" on objects or surfaces within the interior of a pipeline. Such objects can be interior weld beads, bolts or other objects extending into the interior of the pipeline. A branch fitting or the like sometimes forms interior surface that can be engaged by the circumferential knee 24. Any change in the circumferential interior surface of a pipeline can represent a point of interference that can catch on knee 24.

Another problem with the cup of FIG. 1 is that the cup is relatively stiff and inflexible. The cup must be engineered so as to provide support for the pipeline pig body that is attached to flange portion 16 and when so engineered and constructed the cup tends to fit tightly and inflexibly against the wall of a pipeline in which it is positioned; that is, it is not inherently flexible at its rearward portion adjacent the rearward end 14.

FIG. 2, taken in conjunction with FIG. 3, shows an improved cup for supporting an instrument-type pig in a pipeline. The cup of FIG. 2, generally indicated by the numeral 28, has a forward end 30, a rearward end 32, an integral flange portion 34 with openings 36 providing means for attachment to the body of an instrument-type pig and an intermediate portion 38. Intermediate portion 38 has an exterior frustro-conical surface 40 and an interior frustro-conical surface 42. Thus, the improved cup of FIG. 2 and all portions described up to this point is substantially the same as the prior art cup represented by FIG. 1.

The cup of FIG. 2 includes a rearward portion 44 that is of increased diameter adjacent rearward end 32 and has an external arcuate surface 46 when seen in cross-section as in FIG. 2, or which may be described as semi-cylindrical as a three-dimensional portion of the cup is considered. The arcuate surface 46 merges into a substantially cylindrical exterior surface 48 immediately adjacent the cup rearward end 32. The cup rearward portion 44 has an interior surface 50 that is frustro-conical and, in the preferred embodiment illustrated, is coincident with the intermediate portion interior frustro-conical surface 42. The intermediate portion 38 of improved cup 28 has diverging exterior and interior frustro-conical surfaces 40, 42 in the rearward direction.

The improved cup of FIG. 3, that is, the view of the rearward end of the cup of FIG. 2, is therefore substantially identical to the rearward view of the prior art cup of FIG. 1.

The important aspect of cup 28 is the arcuate exterior surface 46 that interconnects the intermediate frustro-conical exterior surface 40 with the rearward cylindrical surface 48 at the rearward end of the cup. Thus, cup 28 has no "knee" as does the prior art cup—that is, it has no abrupt change in the configuration of the exterior surface that would tend to become engaged with or caught on an object extending into the interior of a pipeline.

Cups having completely spherical external surfaces have been known, such as in U.S. Pat. No. 3,755,908 wherein there is no sharp transition in the external surface from the cup intermediate portion to the cup rearward portion. However, spherical-type cups of the type shown in U.S. Pat. No. 3,755,908 do not have the inherent strength to effectively support a heavy pig body. In the alternative, spherical cups of the type shown in U.S. Pat. No. 3,755,908, if of sufficient wall thickness to provide such strength to support a heavy pig body, become inflexible and the cup must be relatively thick throughout, requiring substantially more material than the cup of FIG. 2.

Figure 5:
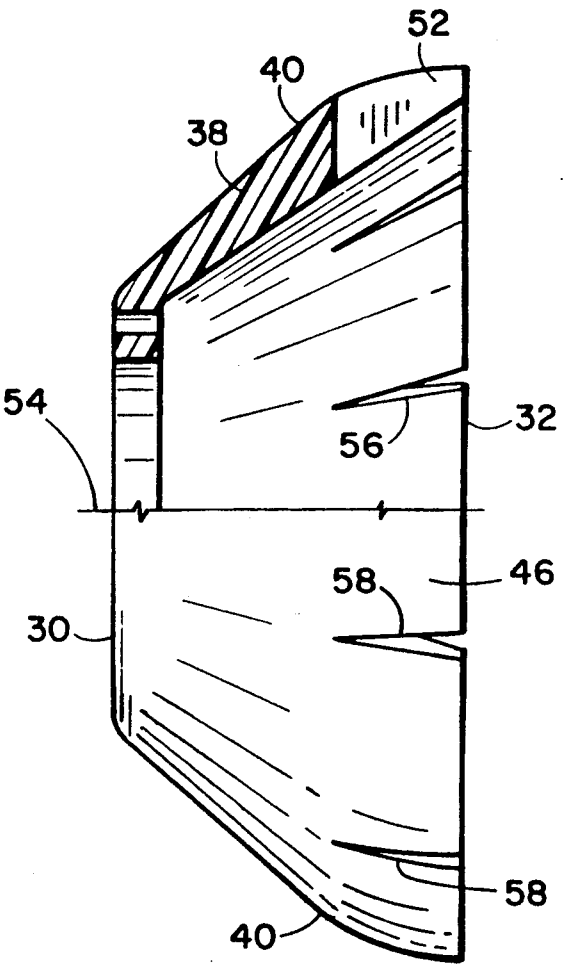
FIG. 5 is a cross-sectional view of the improved embodiment taken along the line 5—5 of FIG. 4.

One problem that has been encountered with cups used to support instrumentation pigs is the need for the combination of strength to support a pig body plus flexibility to permit the cup to safely pass objects protruding into the interior cylindrical surface of a pipeline. FIGS. 4 and 5 show an alternate embodiment of the cup of FIG. 2. In this embodiment the cup rearward portion 44 is provided with a plurality of spaced apart slits 52. Each of the slits 52 is in a plane of the cup axis 54. The slits 52 preferably are of a depth as measured from the cup rearward end 32 toward forward end 30 to reach intermediate portion 38 where exterior surface 40 is frustro-conical, that is, slits 52 extend through the cup rearward portion 44 having the arcuate surface 46 therein.

The number of and spacing of slits 52 can vary. Larger diameter cups have more numerous slits. Further, when a cup is designed for a pig body that is of lighter weight, then more slits 52 may be employed, whereas if the cup must support a relatively heavier pig body then relatively fewer slits 52 are employed. Flexibility of the cup is increased by the number of slits 52 and, therefore, the number of slits is a trade-off between increased flexibility and slightly decreased weight supporting capability.

To further enhance the flexibility of the improved cup of FIGS. 4 and 5, grooves are placed in the exterior and interior surfaces at each of the slits 52. Grooves 52 are formed, as shown in FIG. 5, in the interior surface 50 of the cup rearward portion 44 and grooves 58, as seen in FIG. 5, are formed in exterior surface 46 of the cup rearward portion. The interior and exterior grooves 56, 58 formed at each slit 52 substantially increases the flexibility of the cup, allowing the cup to pass restrictions within a pipeline in which the cup is used or objects protruding into the pipeline.

The use of slits in a cup of the cylindrical type is shown in FIG. 3 of U.S. Pat. No. 3,755,908. However, the combination of slits 52 with grooves 56, 58 further improves the flexibility of the cup. Exterior grooves 58 permit the cup to flex or fold inwardly since the grooves relieve compression that would otherwise be required in the exterior surface for an inward fold. Correspondingly, interior grooves 56 relieve strengthening of interior surface 50 as the cup folds inwardly.

FIGS. 4 and 5 show the arrangement wherein the grooves are provided both in the interior and exterior surface of the cup at each slit. It can be seen that only interior grooves 56 may be employed or only exterior grooves 58, however, the combination of interior and exterior grooves produces superior cup flexibility.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. An improved cup for use on pipeline pigs, such as a caliper pig or the like in which a pig body having one or more cups thereon is moved through the interior of a pipeline, the improved cup comprising:

a unitary cup of resilient material having a central axis and having a forward end and a rearward end;

the cup having at said forward end an integral radially extending circumferential flange portion with an axial opening therethrough, the flange portion providing means of securing the cup on a pipeline pig;

the cup having rearwardly of said flange portion, an integral intermediate portion of generally frustro-conical configuration with an interior frustro-conical surfaces and an exterior frustro-conical surface, the interior and exterior frustro-conical surfaces of said intermediate portion diverge away from each other in the direction towards said cup rearward end, the cup intermediate portion being thereby thicker towards said rearward end; and the cup having a rearward portion of increased diameter adjacent said rearward end, the rearward portion having an external surface and an internal surface, the internal surface merging with said intermediate portion interior frustro-conical surface, and the external surface taken in planes of said central axis arching from said intermediate portion external frustro-conical surface to substantially a cylindrical surface at said rearward end.

2. An improved cup for pipeline pigs according to claim 1 wherein said rearward portion internal surface and said intermediate portion interior surface form a common frustro-conical surface interiorly of the cup.

3. An improved cup for pipeline pigs according to claim 1 wherein said cup rearward portion has a plurality of spaced apart slits therein, each slit being at least substantially in a plane of said cup central axis.

4. An improved cup for pipeline pigs according to claim 1 wherein said cup rearward portion has a plurality of spaced apart grooves formed in said rearward portion external surface.

5. An improved cup for pipeline pigs according to claim 4 wherein each said groove is of substantially V-shaped configuration taken in planes perpendicular to said cup central axis.

6. An improved cup for pipeline pigs according to claim 1 wherein said cup rearward portion has a plurality of spaced apart slits therein, each slit being at least substantially in a plane of said cup central axis and wherein said cup has a groove therein coincident with each said slit.

7. An improved cup for pipeline pigs according to claim 6 wherein each said groove is of substantially V-shaped configuration taken in planes perpendicular to said cup central axis.

8. An improved cup for pipeline pigs according to claim 6 wherein said grooves are in said cup rearward portion exterior surface.

9. An improved cup for pipeline pigs according to claim 6 wherein said grooves are in said cup rearward portion interior surface.

10. An improved cup for pipeline pigs according to claim 6 wherein each said grooves are in said cup rearward portion in both said interior and said exterior surfaces.

11. An improved cup for use on pipeline pigs, such as a caliper pig or the like in which a pig body having one or more cups thereon is moved through the interior of a pipeline, the improved cup comprising:

a unitary cup of resilient material having a central axis and having a forward end and a rearward end;

the cup having at said forward end an integral radially extending circumferential flange portion with an axial opening therethrough, the flange portion providing means of securing the cup on a pipeline pig;

the cup having rearwardly of said flange portion, an integral intermediate portion of generally frustro-conical configuration with an interior frustro-conical surface and an exterior frustro-conical surface; and the cup having a rearward portion of increased diameter adjacent said rearward end, the rearward portion having an external surface and an internal surface, the internal surface merging with said intermediate portion interior frustro-conical surface, and the external surface taken in planes of said central axis arching from said intermediate portion external frustro-conical surface to substantially a cylindrical surface at said rearward end, said cup rearward portion having a plurality of spaced apart slits therein, each slit being at least substantially in a plane of said cup central axis.

12. An improved cup for use on pipeline pigs, such as a caliper pig or the like in which a pig body having one or more cups thereon is moved through the interior of a pipeline, the improved cup comprising:

a unitary cup of resilient material having a central axis and having a forward end and a rearward end;

the cup having at said forward end an integral radially extending circumferential flange portion with an axial opening therethrough, the flange portion providing means of securing the cup on a pipeline pig;

the cup having rearwardly of said flange portion, an integral intermediate portion of generally frustro-conical configuration with an interior frustro-conical surface and an exterior frustro-conical surface; and the cup having a rearward portion of increased diameter adjacent said rearward end, the rearward portion having an external surface and an internal surface, the internal surface merging with said intermediate portion interior frustro-conical surface, and the external surface taken in planes of said central axis arching from said intermediate portion external frustro-conical surface to substantially a cylindrical surface at said rearward end, said cup rearward portion having a plurality of spaced apart grooves formed in said rearward portion external surface.

13. An improved cup for pipeline pigs according to claim 12 wherein each said groove is of substantially V-shaped configuration taken in planes perpendicular to said cup central axis.

14. An improved cup for use on pipeline pigs, such as a caliper pig or the like in which a pig body having one or more cups thereon is moved through the interior of a pipeline, the improved cup comprising:

a unitary cup of resilient material having a central axis and having a forward end and a rearward end;

the cup having at said forward end an integral radially extending circumferential flange portion with an axial opening therethrough, the flange portion providing means of securing the cup on a pipeline pig;

the cup having rearwardly of said flange portion, an integral intermediate portion of generally frustro-conical configuration with an interior frustro-conical surface and an exterior frustro-conical surface; and the cup having a rearward portion of increased diameter adjacent said rearward end, the rearward portion having an external surface and an internal surface, the internal surface merging with said intermediate portion interior frustro-conical surface, and the external surface taken in planes of said central axis arching from said intermediate portion external frustro-conical surface to substantially a cylindrical surface at said rearward end, wherein said cup rearward portion has a plurality of spaced apart slits therein, each slit being at least substantially in a plane of said cup central axis and wherein said cup has a groove therein coincident with each said slit.

15. An improved cup for pipeline pigs according to claim 14 wherein each said groove is of substantially V-shaped configuration taken in planes perpendicular to said cup central axis.

16. An improved cup for pipeline pigs according to claim 14 wherein said grooves are in said cup rearward portion exterior surface.

17. An improved cup for pipeline pigs according to claim 14 wherein said grooves are in said cup rearward portion interior surface.

18. An improved cup for pipeline pigs according to claim 14 wherein each said grooves are in said cup rearward portion in both said interior and said exterior surfaces.

* * * * *